US006109513A

United States Patent [19]

Dugan

[11] Patent Number: 6,109,513

[45] Date of Patent: Aug. 29, 2000

[54] COLLAPSIBLE CONTAINER

[75] Inventor: Thomas F. Dugan, Fort Wayne, Ind.

[73] Assignee: Dugan Neff Corporation, Fort Wayne, Ind.

[21] Appl. No.: 09/167,369

[22] Filed: Oct. 6, 1998

[51] Int. Cl.[7] ..... B65D 5/36

[52] U.S. Cl. ..... 229/122.28; 229/117; 229/122.3

[58] Field of Search ..... 229/117, 122.28, 229/122.3, 125.19, 125.33; 206/600

[56] References Cited

U.S. PATENT DOCUMENTS

| | | | |
|---|---|---|---|
| 642,128 | 1/1900 | Kane | 229/122.3 |
| 805,234 | 11/1905 | Rutledge | 229/117.01 |
| 1,652,844 | 12/1927 | Van Wormer | 229/122.28 |
| 1,700,733 | 2/1929 | Berkowitz | 229/117 |
| 2,990,099 | 6/1961 | Ryder . | |
| 3,722,782 | 3/1973 | Collie . | |
| 4,266,716 | 5/1981 | Austin | 229/117 |
| 4,671,450 | 6/1987 | Lopez . | |
| 4,739,922 | 4/1988 | Zimmermann | 229/122.1 |
| 4,830,271 | 5/1989 | Lau et al. | 229/117 |
| 4,976,355 | 12/1990 | Crutchfield | 206/457 |
| 5,042,714 | 8/1991 | Hall | 229/117 |
| 5,074,460 | 12/1991 | Hanekamp | 229/117 |
| 5,183,200 | 2/1993 | Okamoto | 229/117 |
| 5,301,872 | 4/1994 | Tusing et al. | 229/117.03 |
| 5,318,219 | 6/1994 | Smith | 229/117.05 |
| 5,601,232 | 2/1997 | Greenlee | 229/117.05 |

FOREIGN PATENT DOCUMENTS

| | | | |
|---|---|---|---|
| 964 | 1/1911 | United Kingdom | 229/117.01 |

*Primary Examiner*—Gary E. Elkins
*Attorney, Agent, or Firm*—Baker & Daniels

[57] ABSTRACT

A collapsible container having a deployed position in which articles may be positioned therewithin and a collapsed position for minimizing the profile of the container when not in use. The container is comprised of a wall member and a pair of bottom members including bottom panels and flaps which affix the bottom panels to the wall member. In the collapsed position, the bottom panels are stored within the outer confines of the wall member so that the profile of the container in the collapsed position is minimized.

10 Claims, 4 Drawing Sheets

COLLAPSIBLE CONTAINER

BACKGROUND OF THE INVENTION

1. Field of the Invention

The present invention relates in general to a storage and shipping container and in particular to a collapsible container providing container area to prevent migration of material stored and shipped therein and being collapsible to a minimum size profile when not in use.

2. Description of the Related Art

Pallets have been used for many years by shippers and transporters of various materials. Pallets typically provide a flat and sturdy surface on which materials can be placed and stacked. The pallets are generally manufactured of wood which is mounted on skids so that forklifts can approach the pallet in various directions and quickly and easily lift and move the pallet. In order to ensure that the materials remain on the pallet, it has become commonplace to employ various sized and shaped containers, sometimes being attached to the tops of the pallets, to present a bounded area in which to place and/or remove the materials being shipped or stored. Early pallet containers were problematic in that they were not collapsible so that a significant amount of storage area was taken up if the containers were stored for reuse. As a result, the containers sometimes were destroyed, in which case only the wooden pallets were reused.

To address the problem of reducing the size of pallet containers, collapsible containers were designed. Collapsible containers that have been conventionally associated with pallets range from four walls and a bottom which utilized the pallet top surface as a support, to more intricate collapsible pallet-container combinations.

It is desirable in the collapsible container art to create an inexpensive, easy to assembly container that can be used with a variety of pallets. It is also desirable to provide a collapsible container having a smaller profile when collapsed.

SUMMARY OF THE INVENTION

The present invention comprises a collapsible container comprised of a wall member having bottom panels affixed thereto. In the collapsed position, the bottom panels retract completely within the outer confines of the wall member. The present invention provides a convenient, easy to use and inexpensive collapsible container having a profile which is minimized in the collapsed position.

The present invention, in one form thereof, is a collapsible container having a deployed position in which articles may be positioned therewithin and a collapsed position for minimizing the profile of the container when not in use. The container comprises a wall member which is positionable in a substantially rectangular shape corresponding to the deployed position. The wall member is also positionable in a substantially flat shape corresponding to the collapsed position. A pair of bottom members each include a bottom panel and at least one flap hingedly connected thereto. The bottom members fold around a respective bottom edge of the wall member so that the flaps are aligned substantially parallel with the lower surface of the wall member. The flaps are affixed to the wall member with an adhesive or other suitable fastener, such as tape, glue, etc. Each bottom panel also includes a score line about which the bottom panel is foldable. The bottom panels are positionable in a substantially flat shape which corresponds to the deployed position in which the bottom panels interlock to form a floor of the container. The bottom panels are also positionable in a retracted position corresponding to the collapsed position of the container. In moving from the deployed position to the collapsed position, the bottom panels fold about the score lines and hinge with respect to the flaps. In the retracted position, the bottom panels retract into and are stored within the outer confines of the wall member.

In a preferred form of the above described invention, the wall member comprises a plurality of side panels hingedly interconnected, thereby forming the side walls of the container. Each bottom member includes a pair of flaps affixed to outside surfaces of adjacent side panels. The flaps and the bottom panels are hingedly connected to one another at a location substantially corresponding to a bottom edge of a respective side panel. The bottom members are formed thinner than the wall member, thereby reducing the profile of the collapsed container.

In another form thereof, the present invention is a collapsible container comprising four hingedly interconnected side panels. Two bottom panels each having two flaps integrally connected thereto form the bottom of the container. Each flap is connected to a lower outside surface of a respective side panel using an adhesive or other suitable fastener. A fold separates the bottom panels from the flaps thereby creating a hinge therebetween. Additionally, each bottom panel includes a score line about which the bottom panel is foldable. Thus, in the deployed position, the side panels are disposed in a substantially rectangular shape and the bottom panels are disposed in a substantially flat shape and are interlocked. In the collapsed position, the side panels are disposed in a substantially flat shape and the bottom panels are disposed therewithin, whereby the profile of the container in the collapsed position is minimized.

One advantage of the present invention is that it produces a minimally sized container in the collapsed position. This is so because the bottom panels of the container of the present invention retract within the side walls when the container is collapsed. The present invention provides a container having a collapsed profile roughly 25% smaller than a similarly sized container in which the container bottom folds outside the side walls in the collapsed position.

Another advantage of the present invention is that the bottom panels and the side panels are separate and can therefore be constructed of different types and thicknesses of materials. By selecting a thinner material for the bottom members than for the side panels, the profile of the collapsed container of the present invention is even further reduced. In this connection, the present invention offers interchangeability and thus enhanced versatility. For example, certain applications may require a container having a waterproof bottom whereas the moisture resistance of the side walls might not be critical. Conveniently, the present invention includes separate side walls and bottom members, thereby allowing different types of materials to be used. Thus, a container requiring a waterproof bottom and conventional sidewalls is possible with the present invention.

Another advantage of the present invention is that the pair of bottom panels used to form the container bottom are identical to one another. Thus, only two separate parts, viz., a wall member and a bottom member, need be produced to form the completed container in accordance with the present invention.

Still another advantage of the present invention is that the lower periphery of the container, which is most subject to structural stress, is reinforced. The bottom members of the present invention include flaps hingedly connected thereto.

The flaps abut against and are adhesively connected to the bottom lower surfaces of the container sidewalls. As such, the combination of container sidewalls with flaps affixed thereto forms a structurally superior foundation for the deployed container.

Still another advantage of the present invention is that it can be constructed in a plurality of sizes. The container of the present invention can be formed substantially square or substantially rectangular and can be sized to match the size of commercially available wood pallets.

Another advantage of the present invention is its ease of assembly. Pressure is simply manually exerted on two side walls of the collapsed container and the container automatically folds into the deployed position.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
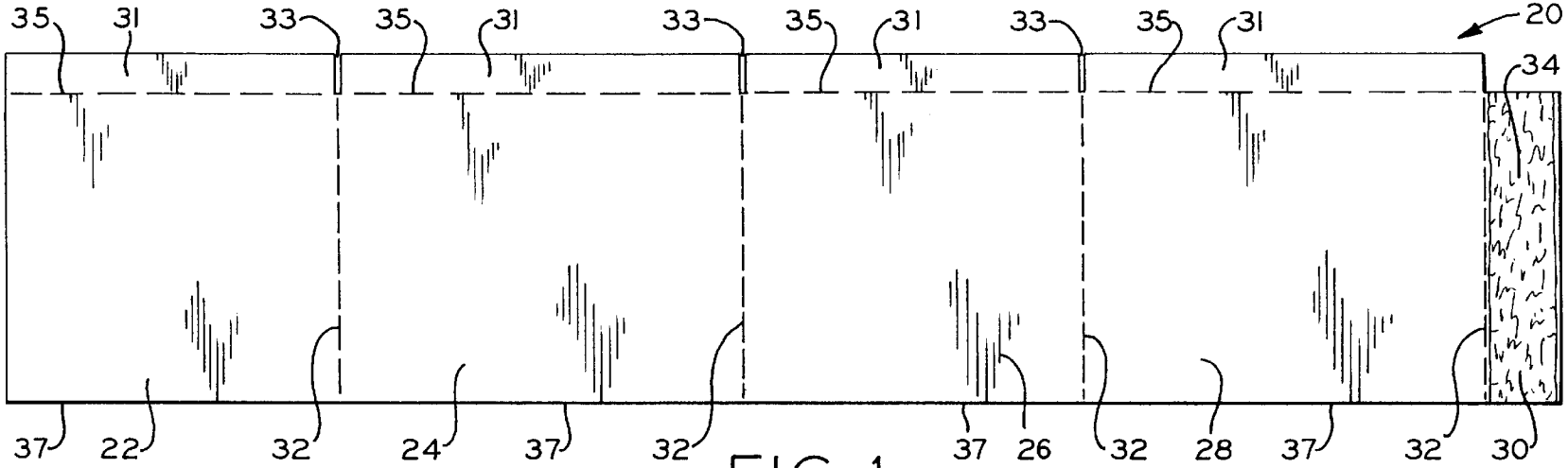
FIG. 1 is a plan view of an unassembled wall member in accordance with the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DETAILED DESCRIPTION OF THE INVENTION

The embodiment disclosed below is not intended to be exhaustive or limit the invention to the precise form disclosed in the following detailed description. Rather, the embodiment is chosen and described so that others skilled in the art may utilize the teachings of the invention.

Wall member 20 in accordance with container 10 the present invention is shown in FIG. 1. Wall member 20 in the illustrated embodiment is formed from single, double or triple wall corrugated paperboard, preferably of triple wall material. Wall member 20 includes four side panels 22–28 and side flap 30, all of which are hingedly interconnected. That is, folds 32 interconnect the respective panels and flaps of wall member 20. To form the assembled wall member 20, side flap 30 having adhesive 34 thereon is adhesively attached to side panel 22. Alternatively, flap 30 could be eliminated, in which case a tape joint may be used to interconnect panel 28 to panel 22. Similarly, staples can be used instead of adhesive 34. For the purposes of this specification, the word "adhesively" is used broadly and includes glue, tape, staples and the like. Wall member 20 is positionable in a substantially rectangular shape corresponding to the deployed position and is also positionable in a substantially flat shape corresponding to the collapsed position. In moving between the two positions, the wall member folds about folds 32. Wall member 20 also includes, optionally, top flaps 31 separated by cutouts 33. Top flaps 31 are foldable with respect to the side panels about folds 35. After the container is assembled, flaps 31 may be folded flat and interlocked so that they are disposed parallel to the surface of the pallet on which the container is placed. Such an arrangement provides a broader surface for supporting, for example, an additional pallet placed on top of the container. Flaps 31 are optional.

Figure 2:
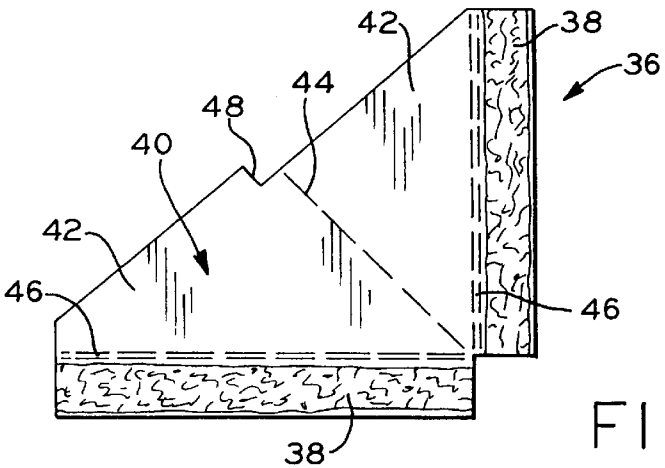
FIG. 2 is a plan view of an unassembled bottom member in accordance with the present invention.

Turning now to FIG. 2, each completed container in accordance with the illustrated embodiment includes two identical bottom members 36, only one of which is shown in FIG. 2. Bottom members 36 are typically thinner than wall member 20. Bottom members 36 are formed of single or double wall paperboard corrugated, as opposed to the triple wall corrugated from which wall member 20 is preferably formed. Bottom member 36 includes bottom flaps 38 integrally formed with a bottom panel 40. Bottom panel 40 is further divided into panel halves 42 by score line 44. Score line 44 can be formed as a fold in bottom panel 40. It is to be understood that for the purposes of this specification, a score line, fold or crease are synonymous terms, in that they can be used interchangably. A "perforation" is another means for forming a fold and can also be used in this application in lieu of a fold, crease or score line. Bottom panel 40 is foldable about score line 44. Bottom member 36 also includes folds 46 so that flaps 38 are hingedly connected to bottom panel 40. Folds 46 are adapted so that flaps 38 can be folded around bottom edges 37 of side panels 22–28. Bottom panel 40 also includes notch 48. As described below, in a deployed container in accordance with the illustrated embodiment, notches 48 of two identical bottom panels 40 interlock.

Figure 3:
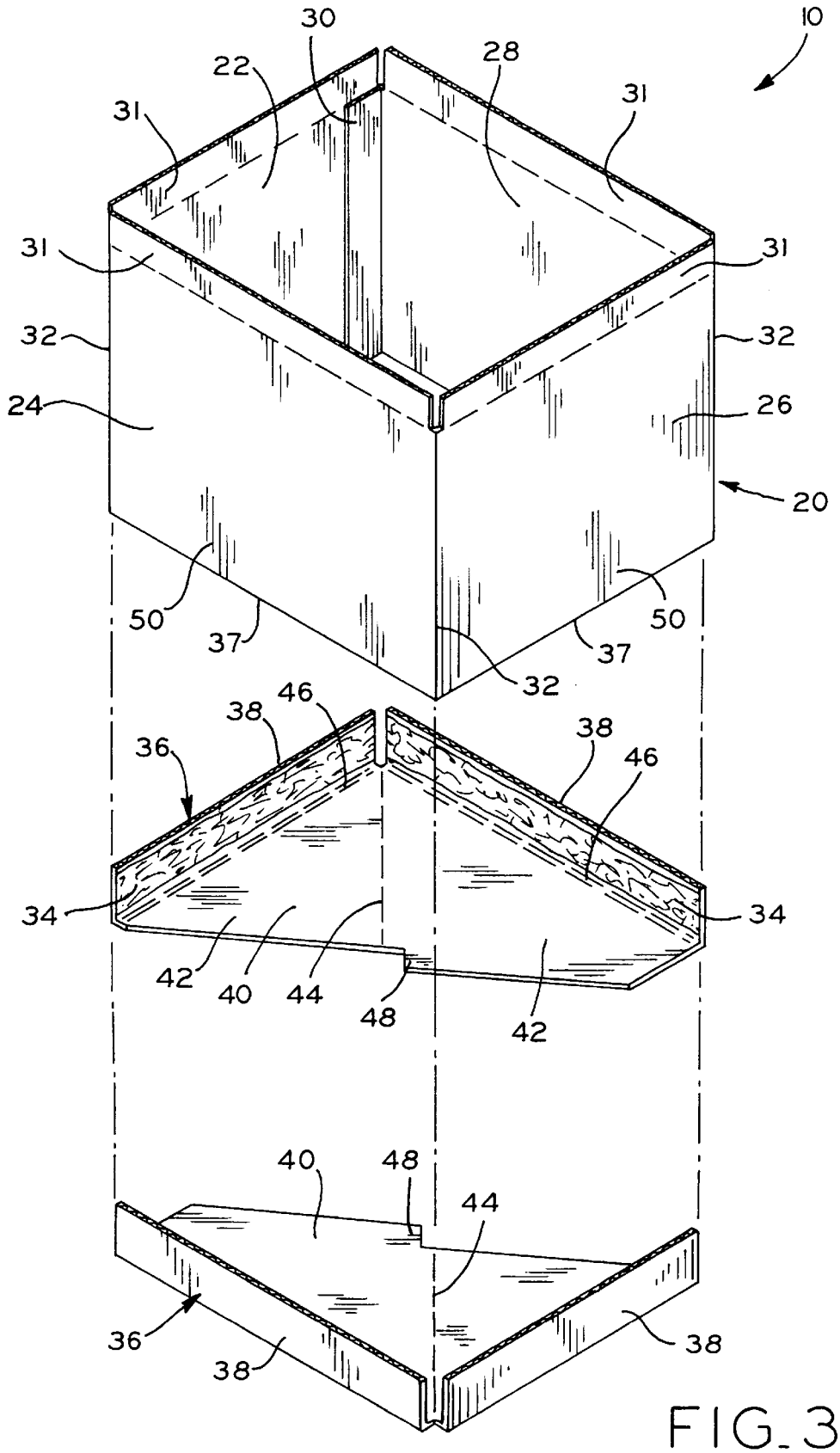
FIG. 3 is an exploded perspective view of a container in accordance with the present invention.

The assembly of the completed container 10 can be understood with reference to FIG. 3. Wall member 20 can be assembled into a substantially rectangular shape as shown in FIG. 3 by adhering flap 30 to side panel 22 using adhesive 34 (FIG. 1). In such an arrangement, side panels 22–28 form substantially vertical sidewalls of the deployed container. Wall member 20 includes lower surfaces 50 on each of its side panels 22–28. In the assembled container as shown in FIG. 3, flaps 38 align substantially parallel with lower surfaces 50 and are affixed thereto with adhesive 34. That is, each bottom panel 40 includes a pair of flaps 38 affixed to outside lower surfaces 50 of adjacent side panels. It can thus be appreciated that flaps 38 and bottom panels 40 are hingedly connected to one another at a location substantially corresponding to bottom edge 37 of the respective side panel. While flaps 38 are shown in the figures as being adhered to the outside lower surfaces 50, it is to be understood that flaps 38 could, alternatively, be adhered to the inside lower surfaces of side panels 22 to 28. Alternatively, staples or tape can be used to connect flaps 38 to lower surfaces 50 instead of adhesive 34. The means by which flaps 38 can be connected to lower surfaces 50 include white glue, spray adhesives, hot melt glass, double sided tape, fiber reinforced tape, staples, and pressure sensitive adhesives. In this manner, two identical bottom members 36 are affixed to wall member 20. In the assembled container, it can be appreciated that the bottom panels are positioned in a substantially flat shape in which panel halves 42 are unfolded about score lines 44. Additionally, it can be seen from FIG. 3 and particularly in FIG. 6 that the identical bottom members 36 partially overlap through the interlocking connection of notches 48. In the assembled container, the interlocking connection and partial overlap of the bottom panels 40 form a firm base for container 10.

Figure 4:
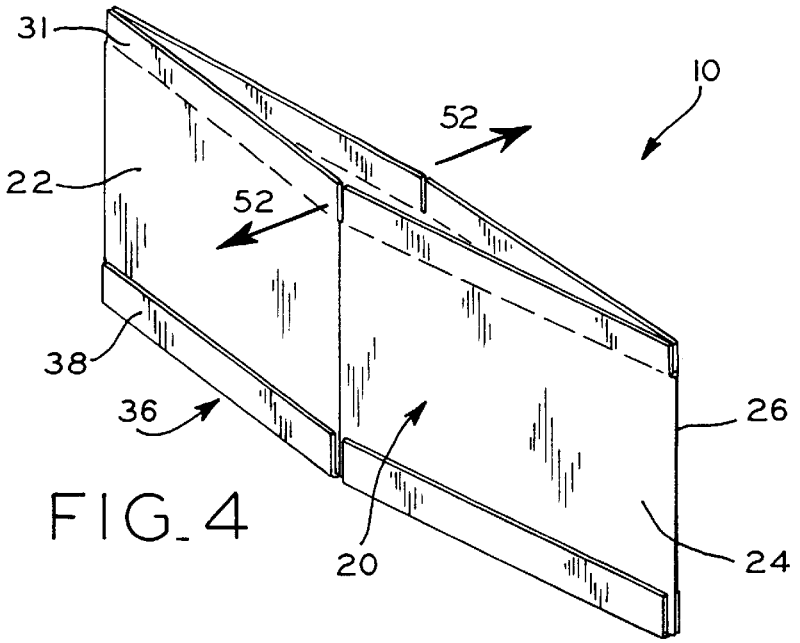
FIG. 4 is a perspective view of a container in the collapsed position in accordance with the present invention.
Figure 5:
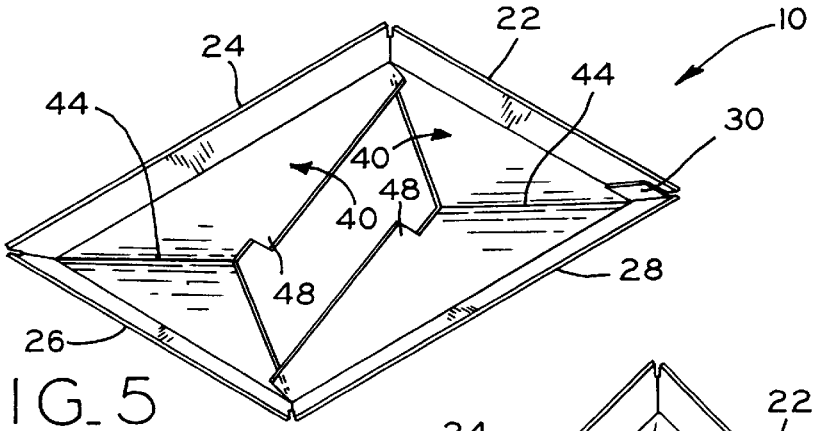
FIG. 5 is a perspective view of a container positioned partially between the collapsed position and the deployed position in accordance with the present invention.
Figure 6:
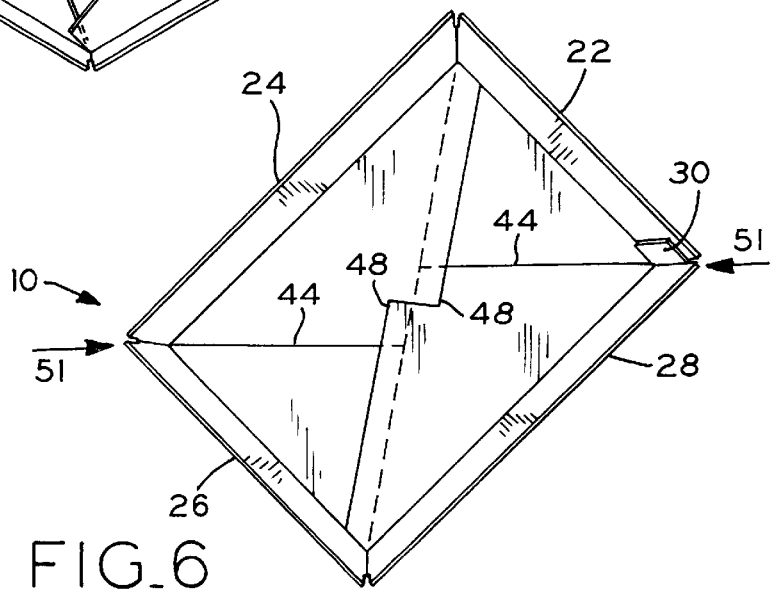
FIG. 6 is a perspective view of a container shown in the deployed position in accordance with the present invention.

The deployed position of container 10 shown in FIG. 6 can be folded into the collapsed position as shown in FIG. 4. Significantly, the bottom panels 40 fold inwardly, or retract, so that the bottom panels are stored within the outer confines of wall member 20 as shown in FIG. 4. In moving from the deployed position to the collapsed position, the user need only lift the container so that the bottom of the container can be accessed. Then, slight pressure is applied upwardly to the outside bottom of the container around the area of notches 48 to free the bottom panels from one another. That is, the mating of the notches which are formed from the edges of the bottom panels is the sole means of securing the bottom panels in the deployed position. Therefore, it only requires slight pressure to free the bottom panels from their mating engagement. The side panels of the container are then folded toward one another in the direction of arrows 51 as shown in FIG. 6 to form the collapsed position shown in FIG. 4. Collapsed container 10 shown in FIG. 4 can be deployed by applying pressure to the side panels of the container in the direction of arrows 52 as shown in FIG. 4. In moving from the collapsed position of FIG. 4 to the deployed position of FIG. 6, bottom panels 40 fold about score lines 44 and hinge with respect to flaps 38 about folds 46 as shown in FIG. 5. In so doing, bottom panels 36 move to a substantially flat position which corresponds to the deployed position shown in FIG. 6. In the deployed position, bottom panels 40 are oriented at an angle of approximately 90° with respect to flaps 38. In the collapsed position, bottom panels 40 are oriented at an angle of approximately 0° with respect to flaps 38.

Figure 7:
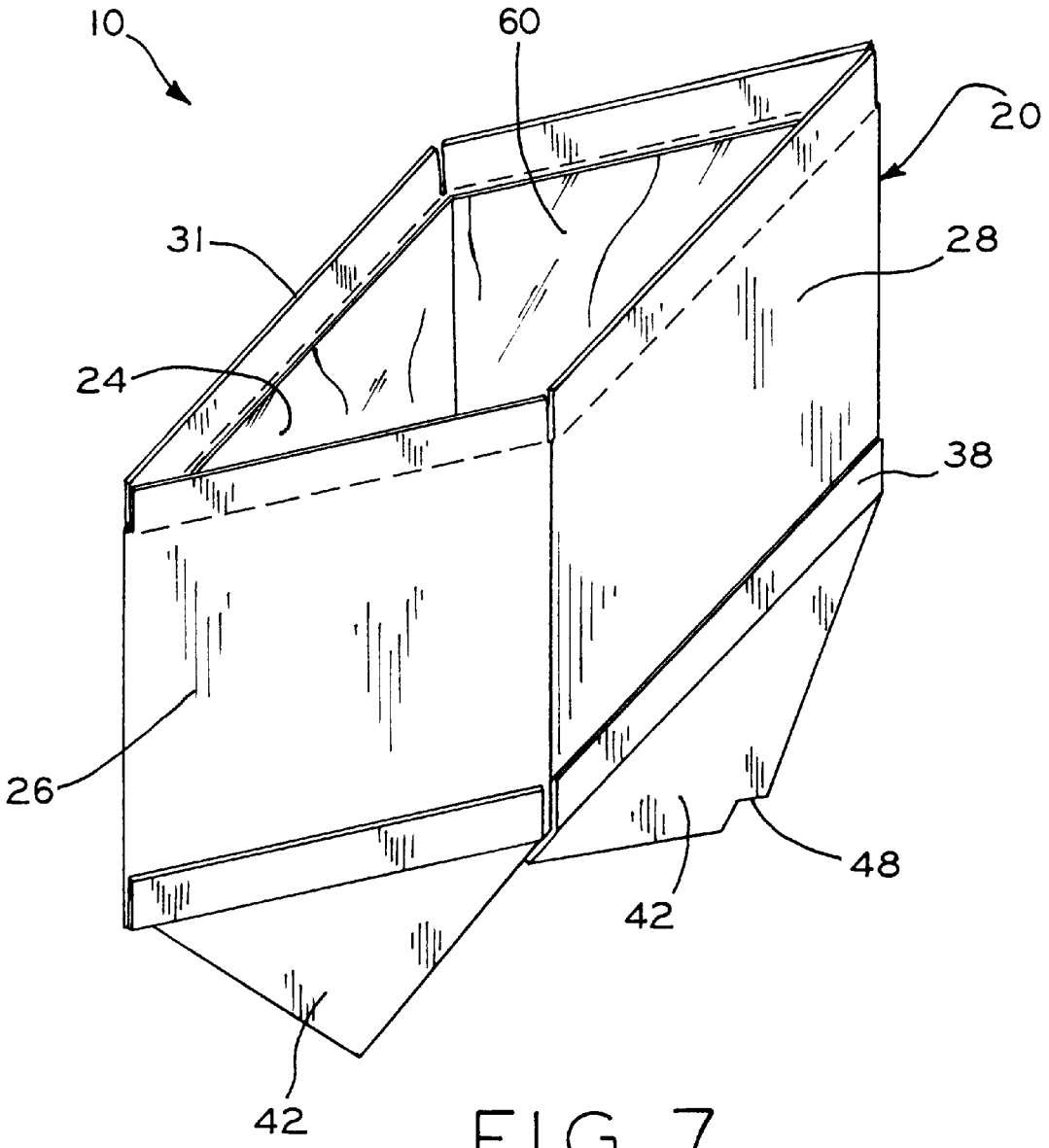
FIG. 7 is a perspective view of a second embodiment in accordance with the present invention.

Turning now to FIG. 7, another feature of the present invention is illustrated. As shown in FIG. 7, bottom panels 36 can be folded outwardly from wall member 20 in collapsed container 10. Such an arrangement is desirable when, for example, a liner 60 is to be installed on the interior of container 10. Liner 60 can be formed from polyethylene, polypropylene, vinyl etc. and is used in applications when it is desirable to insulate the corrugated material from degradative effects caused by the container contents. By allowing the bottom panels to fold outwardly, the bottom panels do not interfere with liner 60. In operation, the collapsed position with the bottom panels folded outwardly of the container is achieved by pushing downwardly on the bottom panels of a deployed container and pressing inwardly on the container walls so that the container collapses as shown in FIG. 7.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A collapsible container having a deployed position in which articles may be positioned therewithin and first and second collapsed positions for storing said container when not in use, said container comprising:

four hingedly interconnected side panels;

two bottom panels each having two flaps integrally connected thereto, each said flap being adhesively connected to a lower surface of a respective one of said side panels, said bottom panels being hingeable with respect to said flaps;

each said bottom panel including a score line about which each said bottom panel is foldable, each said bottom panel comprising an edge having a notch, said notches mating with one another in said deployed position, said mating being the sole means of securing said bottom panels in said deployed position; and wherein, in said deployed position said side panels are disposed in one of a substantially rectangular and a substantially square shape, said bottom panels are interlocked and form a substantially flat shape, whereby said side panels form container side walls and said bottom panels form a container bottom; and in said first collapsed position said side panels are disposed in a substantially flat shape and said bottom panels and said flaps are disposed therewithin, whereby the profile of said container in said first collapsed position is minimized; and in said second collapsed position, said side panels form a substantially flat shape and said bottom panels are folded outwardly of said side panels.

2. The container of claim 1, wherein said bottom panels and said flaps are thinner than said side panels.

3. The container of claim 1, wherein each said flap is adhesively connected to an outside lower surface of a respective one of said side panels.

4. The container of claim 1, wherein said side panels and said bottom panels are comprised of corrugated material.

5. The container of claim 1, wherein each said flap hinges with respect to its respective said bottom panel at a location associated with a bottom edge of a respective one of said side panels.

6. The container of claim 1, wherein two of said side panels are adhesively interconnected.

7. The container of claim 1, wherein said deployed position includes said bottom panels partially overlapping one another.

8. The container of claim 1, wherein said deployed position includes said score lines being substantially parallel to one another.

9. The container of claim 1, wherein said collapsed position includes said flaps and said bottom panels being oriented at an angle of approximately 0° with respect to said flaps, whereas said deployed position includes said bottom panels being oriented at an angle of approximately 90° with respect to said flaps.

10. A collapsible container having a deployed position in which articles may be positioned therewithin and a collapsed position for storing said container when not in use, said container comprising:

a plurality of hingedly interconnected side panels;

a pair of identical foldable bottom panels, each said bottom panel including at least one flap integrally connecting each said bottom panel to a respective one of said side panels, said bottom panels and said flaps being thinner than said side panels;

wherein, in said deployed position, said bottom panels interlock and form a substantially flat shape corresponding to a container bottom, said side panels form substantially vertical container walls, and in said collapsed position said side panels form a substantially flat shape and said bottom panels are folded therewithin, whereby the profile of said container in said collapsed position is minimized.

* * * * *